US005562427A

United States Patent [19]

Mangyo et al.

[11] Patent Number: 5,562,427

[45] Date of Patent: Oct. 8, 1996

[54] FILTER ARRANGEMENT FOR A REFRIGERANT COMPRESSOR

[75] Inventors: Masao Mangyo, Fujisawa; Seishi Nakaoka, Chigasaki; Shuichi Yakushi; Shinya Ito, both of Yokohama; Takao Kawashima, Kawasaki; Satoshi Wada; Hideki Kawai, both of Fujisawa, all of Japan

[73] Assignee: Matsushita Refrigeration Company, Osaka, Japan

[21] Appl. No.: 296,382

[22] Filed: Aug. 26, 1994

Related U.S. Application Data

[62] Division of Ser. No. 140,908, Oct. 25, 1993, Pat. No. 5,402,655.

[30] Foreign Application Priority Data

| | | | |
|---|---|---|---|
| Oct. 23, 1992 | [JP] | Japan | 4-285732 |
| Feb. 10, 1993 | [JP] | Japan | 5-22332 |
| Feb. 10, 1993 | [JP] | Japan | 5-22333 |

[51] Int. Cl.[6] ..... F04B 39/16

[52] U.S. Cl. ..... 417/313; 417/902; 55/523; 95/902; 62/474

[58] Field of Search ..... 417/313, 902; 418/47; 210/416.1, DIG. 7; 55/523, 524; 95/902; 96/118

[56] References Cited

U.S. PATENT DOCUMENTS

| | | | |
|---|---|---|---|
| 1,677,804 | 7/1928 | Thayer . | |
| 1,866,659 | 7/1932 | Litle, Jr. . | |
| 2,153,773 | 4/1939 | Patrigwani | 417/902 |
| 2,325,657 | 8/1943 | Burkness . | |
| 2,353,347 | 7/1944 | McCormack | 418/47 |
| 2,844,302 | 7/1958 | Weibel, Jr. | 417/902 |
| 3,175,342 | 3/1965 | Balogh . | |
| 3,220,167 | 11/1965 | Der Ster et al. . | |
| 4,266,408 | 5/1981 | Krause . | |
| 4,601,179 | 7/1986 | Johansson | 417/313 |
| 4,606,706 | 8/1986 | Utter | 417/313 |
| 4,745,772 | 5/1988 | Ferris . | |
| 4,811,571 | 3/1989 | Mayer . | |
| 4,911,619 | 3/1990 | Todescat et al. | 417/902 |
| 4,916,914 | 4/1990 | Short . | |
| 4,969,804 | 11/1990 | Gannaway | 417/902 |
| 5,021,179 | 6/1991 | Zehler et al. . | |
| 5,027,606 | 7/1991 | Short . | |
| 5,202,044 | 4/1993 | Hagihara et al. . | |
| 5,268,101 | 12/1993 | Anderson et al. | 210/510.1 |
| 5,290,465 | 3/1994 | Sabahi . | |
| 5,364,450 | 11/1994 | Sciuto | 210/DIG. 6 |

FOREIGN PATENT DOCUMENTS

| | | |
|---|---|---|
| 2656664 | 11/1979 | Germany . |
| 4035071 | 5/1992 | Germany . |
| 61-47994 | 10/1986 | Japan . |
| 62-200157 | 9/1987 | Japan . |
| 2-153274 | 6/1990 | Japan . |
| 3-128992 | 5/1991 | Japan . |
| 3-128991 | 5/1991 | Japan . |
| 3-290073 | 12/1991 | Japan . |

*Primary Examiner*—Timothy S. Thorpe
*Assistant Examiner*—Roland G. McAndrews, Jr.
*Attorney, Agent, or Firm*—Lowe, Price, Leblanc & Becker

[57] ABSTRACT

A porous filter having a pore size of no more than 80 μm is provided in a refrigerant flow passage of a refrigeration system. The filter may be provided in a drier provided in the refrigerant flow passage or in a separate filter casing provided in the refrigerant flow passage. Alternatively, the filter may be provided in the refrigerant flow passage within a sealed casing of a refrigerant compressor which is incorporated in the refrigeration system. The filter is formed of a molded solid material constituted by alumina, silica gel, calcium sulfide and aluminosilicate.

2 Claims, 14 Drawing Sheets

FILTER ARRANGEMENT FOR A REFRIGERANT COMPRESSOR

This is a division of copending U.S. patent application Ser. No. 08/140,908, filed on Oct. 25, 1993, now U.S. Pat. No. 5,402,655.

BACKGROUND OF THE INVENTION

1. Field of the Invention

The present invention relates to a refrigerant compressor for compressing a refrigerant or coolant and a refrigeration or cooling system incorporating same, for use in, such as, an electric refrigerator and a car air conditioner.

2. Description of the Prior Art

Recently, in consideration of the environmental pollution and, particularly, the ozone destruction and the global warming, the use of the chlorine-containing freon (chlorofluorocarbons abbreviated as CFC) has been seriously discussed and is going to be regulated worldwidely.

The freon to be regulated includes the chlorine-containing freon, such as, the freon 11, the freon 12, the freon 113, the freon 114 and the freon 115. As a result, the freon 12 which has been widely used as a refrigerant in the refrigeration system incorporated in, such as, the refrigerator and the dehumidifier is also to be regulated.

In the circumstances, a refrigerant which can be a substitute for the freon 12 has been an immediate need, and various kinds of compounds have been researched. Among them, carbon hydride fluoride has been highlighted as an alternate refrigerant for the freon 12 because of its low reactivity with ozone and its short decomposition time in the atmosphere. Particularly, the freon 134*a* (1,1,1-tetrafluoroethane, $CH_2FCF_2$) is known to have prevailing properties. For example, an ozone destruction parameter (ODP)of the freon 134*a* is 0 (zero) when that of the freon 12 (dichlorodifluoromethane, $CCl_2F_2$) is assumed to be 1, and further, a global warming parameter (GWP) of the freon 134*a* is no more than 0.3 when that of the freon 12 is assumed to be 1. Accordingly, the freon 134*a* less affects the global environment and is, in addition, noncombustible. Still further, thermal properties, such as, temperature-pressure characteristics of the freon 134*a* are close to those of the freon 12 so that the refrigeration system of, such as, the refrigerator and the dehumidifier and its refrigerant compressor which have been using the freon 12 can be used without largely modifying their structure. As a result, the freon 134*a* has been prevailing as a substitute for the freon 12.

As is known, the hermetic refrigerant compressor widely employed in, such as, the refrigerator uses an lubricating oil which is filled in a sealed casing of the refrigerant compressor for lubricating its internal compressing unit. This lubricating oil is required to have mutual solubility with the refrigerant so as to ensure the effective recovery of the lubricating oil into the sealed casing. In this respect, the conventional refrigeration system using the freon 12 has been using the mineral oil or the alkylbenzene oil as lubricant.

However, a chemical structure of the freon 134*a* is so special that the conventional lubricating oil containing the mineral oil or the alkylbenzene oil as a main component can not be used as lubricant on a practical basis due to its poor solubility with the freon 134*a*.

In order to overcome this problem, researches were made to attain lubricating oils from known materials having solubility with the freon 134*a*. However, none of them could satisfy the required properties in view of, such as, lubricity, friction resistance and abrasion resistance for sliding parts of the compressor and in view of influence to electrical insulators and desiccants in the refrigeration system.

Further researches have been made for the lubricating oil which has solubility with the freon 134*a* and, in addition, which has practical insulation, lubrication and hygroscopic properties, and finally developed ester lubricating oils for the hydrogen-containing freon refrigerants as disclosed in, such as, Japanese First (unexamined) Patent Publications Nos. 31-28991 and 3-128992. As a result of this, the carbon hydride fluoride refrigerants as represented by the freon 134*a* have become practical for use in the refrigeration system.

On the other hand, no substantial improvement has been made in machine parts of the refrigerant compressor and the refrigeration system for using the carbon hydride fluoride refrigerant.

Hereinbelow, conventional refrigerant compressors and refrigeration systems will be described with reference to the accompanying drawings.

FIG. 17 is a systematic diagram showing a schematic structure of a typical conventional refrigeration system as disclosed in Japanese First (unexamined) Patent Publication No. 62-200157.

The typical conventional refrigeration system includes a refrigerant compressor 1, a condenser 2, a drier 3 incorporating a water adsorber, such as, a molecular sieve and a metal screen filter of about a 150 mesh size, an expansion mechanism 4 with an expansion valve in the form of a capillary tube and an evaporator 5, which are hermetically connected by piping as shown in FIG. 17. The refrigerant and the lubricating oil are enclosed in the refrigeration system for circulation in a direction of an arrow as indicated in FIG. 17.

As the refrigerant compressor 1 employed in the refrigeration system, there are available various kinds of compressors selectable depending on intended use of the refrigeration system.

FIG. 18 is a sectional view showing a typical conventional reciprocating refrigerant compressor. This type of the compressor is disclosed in, such as, Japanese First (unexamined) Patent Publication No. 3-290073. In FIG. 18, the compressor includes a sealed casing 6 which incorporates therein a motor 7 and a reciprocating compressing unit 9. In the compressor, the refrigerant gas circulated from the evaporator is introduced into the sealed casing 6 via an induction pipe 10 and then released into an induction muffler 12. The refrigerant gas is then sucked into an intake tube 14 and further introduced into a cylinder of the compressing unit 9.

In the conventional reciprocating refrigerant compressor, no filter is provided in a refrigerant inflow passage from the induction pipe 10 to the cylinder.

The refrigerant gas introduced into the cylinder is then compressed and flows out through a discharge muffler 15.

FIG. 19 is a sectional view showing the discharge muffler 15. The discharge muffler 15 includes a baffle 17 in a muffler chamber 20. The refrigerant gas compressed by the compressing unit 9 is released into the muffler chamber 20 via a discharge hole 18, and then flows into a discharge pipe line 25 passing an annular gap 22 between the baffle 17 and a mounting bolt 21. The refrigerant gas is then guided to exterior of the sealed casing 6 via the discharge pipe line 25.

In the conventional reciprocating refrigerant compressor, no filter is provided in a refrigerant discharge passage from the cylinder of the compressing unit 9 to the exterior of the sealed casing 6.

FIG. 20 is a sectional view showing a typical conventional rotary refrigerant compressor. This type of the compressor is disclosed in, such as,. Japanese Second (examined) Patent Publication No. 61-47994. In FIG. 20, the compressor includes a sealed casing 31 which incorporates therein a motor 34 formed by a rotor 32 and a stator 33, a rotating shaft 35 firmly fitted through the rotor 32 and a compressing unit 36 operatively coupled to the motor 34 via the rotating shaft 35. In the compressor, the refrigerant gas circulated from the evaporator is released into an induction muffler 28 via an induction pipe 27 and passes through a metal screen filter 29 of a 150 mesh size provided in the induction muffler 28 so as to be introduced into a cylinder 37 (FIG. 21).

As shown in FIG. 21, the refrigerant gas compressed by means of the cylinder 37, a roller 38 and vanes 39 of the compressing unit 36 is discharged into a space within the sealed casing 31 via a discharge muffler 40 as indicated by arrows in FIG. 21. The refrigerant gas is then discharged into the exterior via a discharge pipe 26 mounted to the sealed casing 31.

In the conventional rotary refrigerant compressor, no filter is provided in a refrigerant discharge passage from the cylinder 37 to the exterior of the sealed casing 31.

FIG. 22 is a sectional view showing a typical conventional refrigerant compressor of a car air conditioner. This type of the compressor is disclosed in, such as, Japanese First (unexamined) Patent Publication No. 2-153274. In FIG. 22, the compressor includes a main casing 41 incorporating therein a refrigerant gas compressing section driven by a drive mechanism 43 which is driven by rotation of a rotating shaft 42. To the main casing 41, a block is integrally mounted which includes therein an induction section for feeding the refrigerant to the compressing section and a discharge section for discharging the refrigerant compressed by the compressing section.

Specifically, the refrigerant gas is sucked into a cylinder 45 via an induction muffler 48 provided in the induction section and then compressed due to a reciprocating motion of a piston 44 in the cylinder 45.

In the conventional refrigerant compressor of the car air conditioner, no filter is provided in a refrigerant induction passage from the exterior to the cylinder 45.

The refrigerant gas compressed in the cylinder 45 is discharged into the exterior of the compressor after a temporal stay in the discharge muffler 47.

In the conventional refrigerant compressor of the car air conditioner, no filter is provided in a refrigerant discharge passage from the cylinder 45 to the exterior of the compressor, either.

As aforementioned, the lubricating oils for the freon **134*a*** as disclosed in, such as, Japanese First (unexamined) Patent Publications Nos. 3-128991 and 3-128992 are the ester oils. Accordingly, there has been raised another problem that the ester oils dissolve rubber and resin. As a result, when using the ester lubricating oil, a certain design modification was necessary for rubber and resin parts in the refrigerant compressor to be resistible against dissolution by the ester lubricating oil.

In the circumstances, the present inventors have changed a coating material for a motor coil in the compressor to polyamide imide and a motor insulation film to a crystalline film of polyethylene terephthalate having a glass-transition temperature higher than the conventional film, and further removed a NBR (butadiene-acrylonitrile rubber) member of a damping strap provided in the compressor. In this condition, the freon **134*a*** refrigerant and the lubricating oil containing ester as a main component were filled into the compressor, and a test working of the refrigeration system including this compressor was performed. The result was that no short circuit of the motor, no insulation failure or the like occurred.

However, in the foregoing refrigeration system, there has been raised another serious problem that a cooling power of the refrigeration system became much lower than expectation. The reason for this was found as follows:

During production processes of the compressor and the evaporator, the mineral oil and a solvent are respectively used so that these organic substances, i.e. fats and oils and the like remain inside the refrigeration system. The lubricating oil containing ester as a main component dissolves these organic substances to produce contaminants. These contaminants block or deteriorate the flow of the refrigerant in the capillary tube so as to lower the cooling power or effect of the refrigeration system.

In the circumstances, component parts of the refrigeration system were fully washed using a solvent or a surface active agent, and then the ester oil was filled in. As a result, an amount of the generated contaminants was reduced. Specifically, an amount of the generated contaminants was 0.005 grams when measured after a six-month operation of the refrigerator of 400 liters which incorporates the refrigeration system having the reciprocating refrigerant compressor with a cylinder capacity of 7.7 $cm^3$.

However, the generation of the contaminants in the refrigeration system could not be prevented completely however carefully the component parts of the refrigeration system were washed. Although only a slight amount of the contaminants was generated after the washing, the generated contaminants adversely affect a flow resistance in the capillary tube to an extreme degree to increase the flow resistance of the capillary tube by 10% to 20%. As a result, the lowering of the cooling power could not be avoided in the conventional refrigeration system using the carbon hydride fluoride refrigerant and thus the ester lubricating oil.

This means that the conventional filter, such as, the metal screen filter of about a 150 mesh size can not catch or capture the contaminants generated due to the dissolution of the organic substances by the ester lubricating oil.

SUMMARY OF THE INVENTION

Therefore, it is an object of the present invention to provide an improved refrigerant compressor and an improved refrigeration system.

According to one aspect of the present invention, a refrigeration system comprises a series of a refrigerant flow passage including therein a refrigerant compressor, a condenser, an expansion mechanism and an evaporator; a refrigerant containing, as a main component, a carbon fluoride compound which contains no chlorine; a lubricating oil containing ester as a main component, the lubricating oil having solubility with the refrigerant; and a porous filter provided in the refrigerant flow passage.

According to another aspect of the present invention, a refrigeration system comprises a series of a refrigerant flow passage including therein a refrigerant compressor, a condenser, an expansion mechanism and an evaporator; a refrigerant containing, as a main component, a carbon fluoride compound which contains no chlorine; a lubricating oil containing ester as a main component, the lubricating oil having solubility with the refrigerant; and a filter provided in the refrigerant flow passage, the filter having a pore size of no more than 80 μm.

According to still another aspect of the present invention, a refrigeration system comprises a series of a refrigerant flow passage including therein a refrigerant compressor, a condenser, an expansion mechanism and an evaporator; a refrigerant containing, as a main component, a carbon fluoride compound which contains no chlorine; a lubricating oil containing ester as a main component, the lubricating oil having solubility with the refrigerant; a drier provided between the condenser and the expansion mechanism; and a porous filter provided at one of inlet and outlet sides of the drier.

According to still another aspect of the present invention, a refrigeration system comprises a series of a refrigerant flow passage including therein a refrigerant compressor, a condenser, an expansion mechanism and an evaporator; a refrigerant containing, as a main component, a carbon fluoride compound which contains no chlorine; a lubricating oil containing ester as a main component, the lubricating oil having solubility with the refrigerant; a drier provided between the condenser and the expansion mechanism; and a filter provided at one of inlet and outlet sides of the drier, the filter having a pore size of no more than 80 μm.

According to still another aspect of the present invention, a refrigerant compressor comprises a sealed casing; a motor provided in the sealed casing; a compressing unit provided in the sealed casing to be driven by the motor; and a porous filter provided in at least one of a refrigerant induction passage and a refrigerant discharge passage of the compressing unit.

According to still another aspect of the present invention, a refrigerant compressor comprises a sealed casing; a motor provided in the sealed casing; a compressing unit provided in the sealed casing to be driven by the motor; and a filter provided in at least one of a refrigerant induction passage and a refrigerant discharge passage of the compressing unit, the filter having a pore size of no more than 80 μm.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Now, preferred embodiments of the present invention will be described hereinbelow with reference to the accompanying drawings. In the following description, the same elements or parts as those of the aforementioned prior art are assigned the same reference marks, and the detailed explanation of the same or similar structures or operations as those of the aforementioned prior art will be omitted, in order to avoid redundant disclosure.

Figure 1:
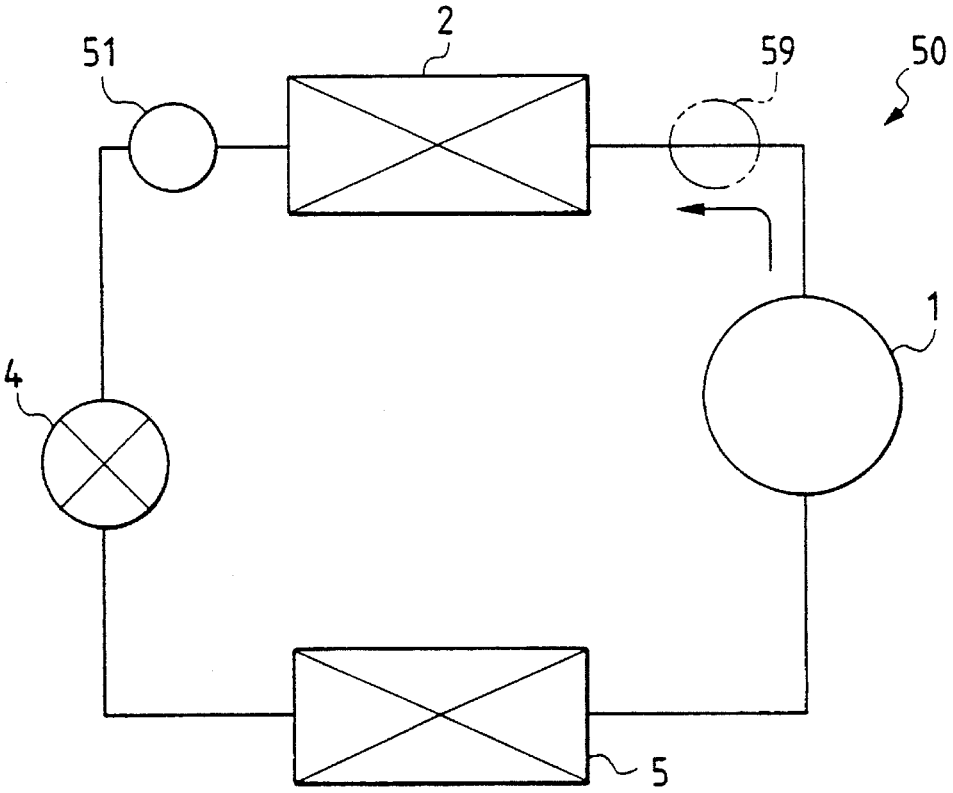
FIG. 1 is a systematic diagram showing a schematic structure of a refrigeration system according to a first preferred embodiment of the present invention.
Figure 2:
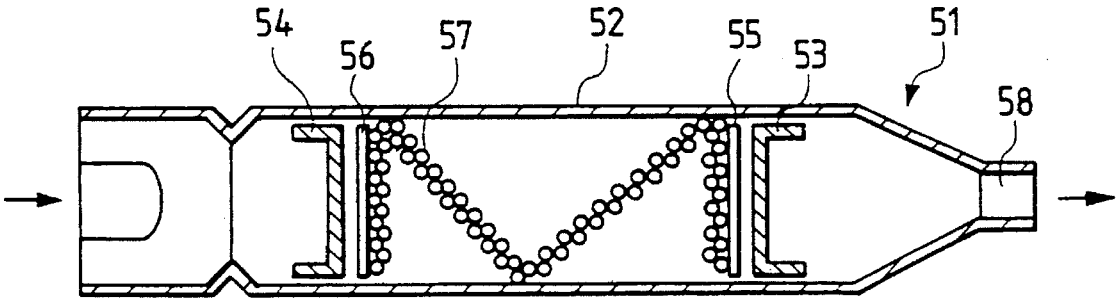
FIG. 2 is a sectional view showing a structure of a drier according to the first preferred embodiment.

FIG. 1 is a systematic diagram showing a schematic structure of a refrigeration system 50 according to a first preferred embodiment of the present invention. In FIG. 1, the refrigeration system 50 incorporates a drier 51 which includes therein filters and is arranged in a refrigerant flow passage of the refrigeration system 50. As shown in FIG. 2, the drier 51 has a drier case 52 in the form of a copper pipe which includes therein filters 53 and 54 each formed of a material of a porous sintered metal, punching metal plates 55 and 56, and a molecular sieve with beads 57.

Specifically, in the drier case 52, the filter 53 is fixedly arranged at a side of an outlet 58 of the drier case 52 while the filter 54 is fixedly arranged at a side of an inlet of the drier case 52. Between the filters 53 and 54, the punching metal plate 55 is fixed adjacent to the filter 53 and the punching metal plate 56 is fixed adjacent to the filter 54. Further, between the punching metal plates 55 and 56, the molecular sieve with the beads 57 is arranged as being fixedly supported by the punching metal plates 55 and 56.

The freon 134*a* is enclosed as a refrigerant in the refrigeration system 50, and the ester lubricating oil is enclosed in the refrigerant compressor 1.

When the refrigeration system 50 is operated, the freon 134*a* is pressurized by the compressor 1 and circulated through the refrigeration system 50, which causes the ester lubricating oil to circulate through the refrigeration system 50. The circulating ester lubricating oil dissolves fats and oils and the like remaining in the refrigeration system 50 to produce contaminants. When the produced contaminants reach the drier 51, these contaminants are captured or caught by the filters 53 and 54 formed of the porous sintered metal provided in the drier 51.

Hereinbelow, relationship between pore size or porosity of the filters 53 and 54 and capturing effect of the contaminants will be explained.

A test was performed by changing the pore size of the filters so as to find out an optimal pore size of the filters. In the test, the refrigeration system is operated for a given time period so as to compare variations of flow rates of the capillary tube before and after the start of the test.

Figure 3:
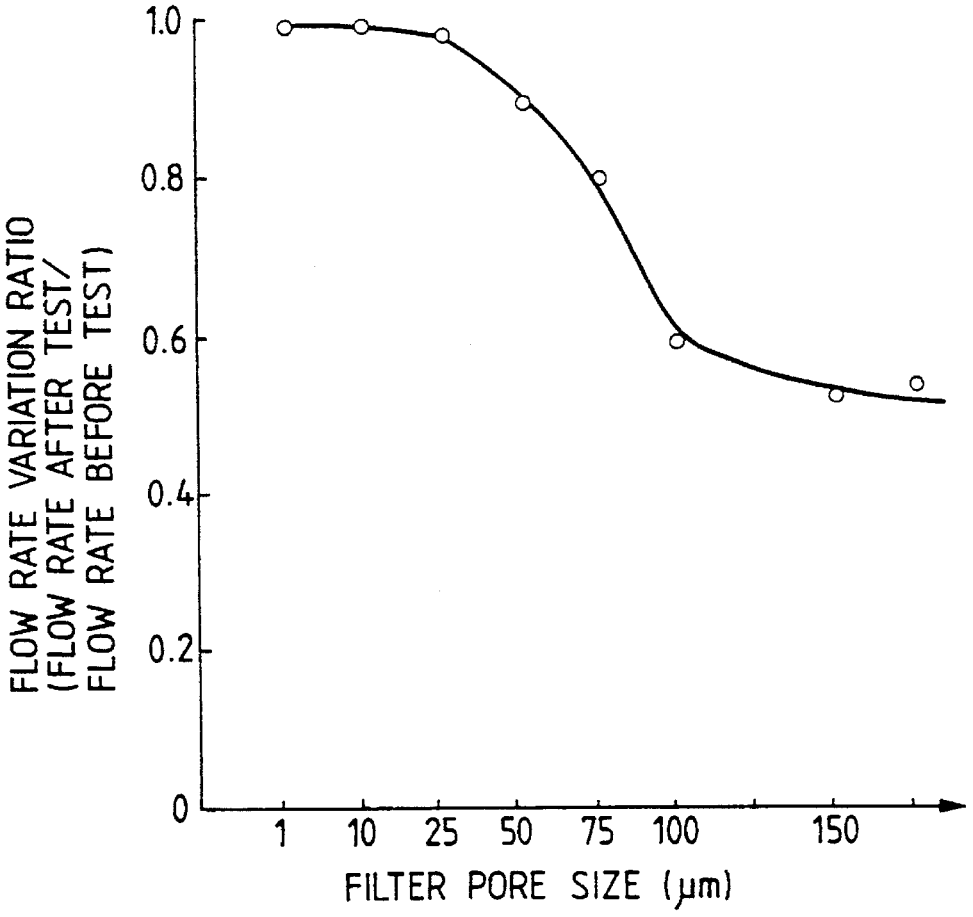
FIG. 3 is a characteristic graph showing a relationship between a filter pore size and a flow rate variation ratio at a capillary tube.

FIG. 3 is a characteristic graph showing the test result. In the graph, the vertical axis represents a flow rate variation ratio (flow rate after test/flow rate before test) at the capillary tube, and the horizontal axis represents a filter pore size (μ m). As the graph shows, the capturing effect of the contaminants is small when the filter pore size is no less than 100 μm where the flow rate variation before and after the test is constantly large, that is, the flow rate variation ratio is small in FIG. 3. On the other hand, when the filter pore size is no more than 80 μm, the flow rate variation is significantly improved, that is, the flow rate variation is made smaller. This is considered to represent that the capturing effect of the contaminants is significantly high when the filter pore size is no more than 80 μm. It is further understood from the graph that the flow rate variation before and after the test is not substantially caused when the filter pore size is no more than 25 μm.

To sum up, it is understood from the graph that the filter pore size of no more than 80 μm is preferable in view of reducing the flow rate variation before and after the test, and the filter pore size of no more than 75 μm is more preferable for providing more significant effect. Further, in view of more reducing the flow rate variation before and after the test, the filter pore size of 10 μm to 50 μm is preferable. On the other hand, in consideration of a flow resistance when the refrigerant passes through the filter, which increases as the filter pore size reduces, the most preferable filter pore size is about 37 μm to 75 μm.

This test result is applied to all filters which will be described hereinbelow. Accordingly, all the filters which will be described hereinbelow respectively have a filter pore size of no more than 80 μm.

Now, a material of the filters 53 and 54 will be described hereinbelow.

When the porous sintered metal is used as described above, bronze or stainless steel is preferable as its material metal. In this case, the filter may have, such as, a capsule shape or a cartridge shape.

As a modification, porous burnt-hard desiccant may be used as a material of the filter. In this case, alumina, silica gel, calcium sulfide and aluminosilicate as water-absorbing components are mixed with a binder at a given ratio, which mixture is then burnt at about 500° C. to form a porous burnt-hard desiccant having sufficient water absorbing and holding properties. A filter pore size of 70 μm is preferable.

As another modification, porous resin may be used as a material of the filter. In this case, a thin film of polyester, cellulose, silicon or the like which may be selected among materials for use in the blood dialysis for a human body, is preferable for forming the filter.

As another modification, porous metallic fiber may be used as a material of the filter. In this case, a stack of steel wool is preferable for forming the filter.

As another modification, porous paper may be used as a material of the filter. In this case, thick porous paper, for example, used as an element of the normal air filter is used preferably in the form of bellows so as to increase a surface area thereof.

As another modification, porous non-woven fiber may be used as a material of the filter. In this case, polyester fiber is preferable.

As another modification, porous inorganic ceramic may be used as a material of the filter. In this case, a filter element of a normal water filtering device or a normal filter plate available in the chemical industry may be formed into a required shape so as to attain the filter.

The filters 53 and 54 may be formed of different materials selected from the above-noted materials.

In the first preferred embodiment, the filter is provided at a conventional position of the drier 51, i.e. between the condenser 2 and the expansion mechanism 4 formed by the capillary tube. However, the filter may be provided at a position 59 between the compressor 1 and the condenser 2 as indicated by a two-dot chain line in FIG. 1.

Now, a second preferred embodiment of the present invention will be described hereinbelow with reference to FIG. 4 which is a partly sectional view showing a drier 51*a* according to the second preferred embodiment.

The second preferred embodiment differs from the first preferred embodiment only in the structure of the drier 51*a*.

Figure 4:
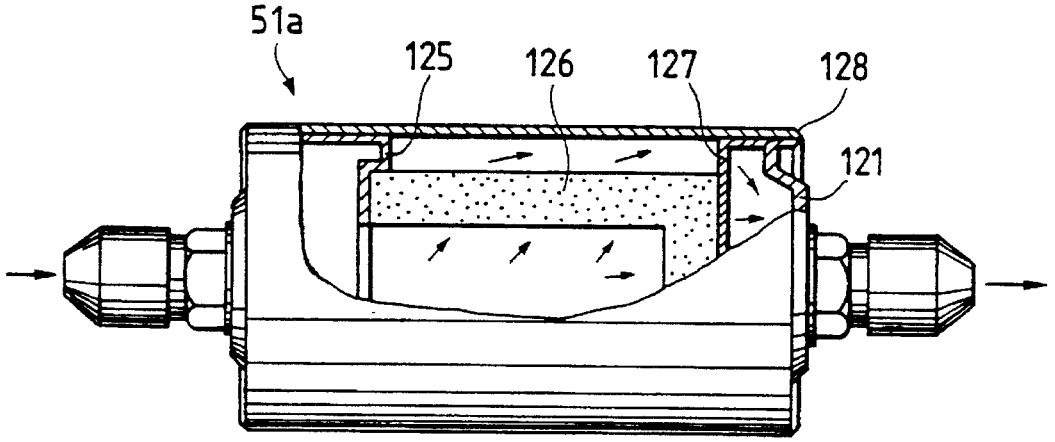
FIG. 4 is a partly sectional view showing a structure of a drier according to a second preferred embodiment of the present invention.

In FIG. 4, the drier 51*a* includes a cover 121 fixed to an outlet of a copper case 128 of the drier, a strainer 125 fixed at an inlet side of the case 128, a metal screen 127 of about a 150 mesh size fixedly provided at an outlet side of the case 128, and a solid core 126 fixedly provided between the strainer 125 and the metal screen 127.

The solid core 126 is a molded burnt-hard porous filter formed by mixing alumina, silica gel, calcium sulfide and aluminosilicate as water-adsorbing components with a binder at a given ratio and burning this mixture at about 500°. The solid core 126 has a filter pore size of about 70 μm.

The solid core 126 allows the freon 134*a* and the ester lubricating oil to pass therethrough while effectively captures the contaminants produced due to the dissolution of fats and oils and the like by the ester lubricating oil.

Figure 5:
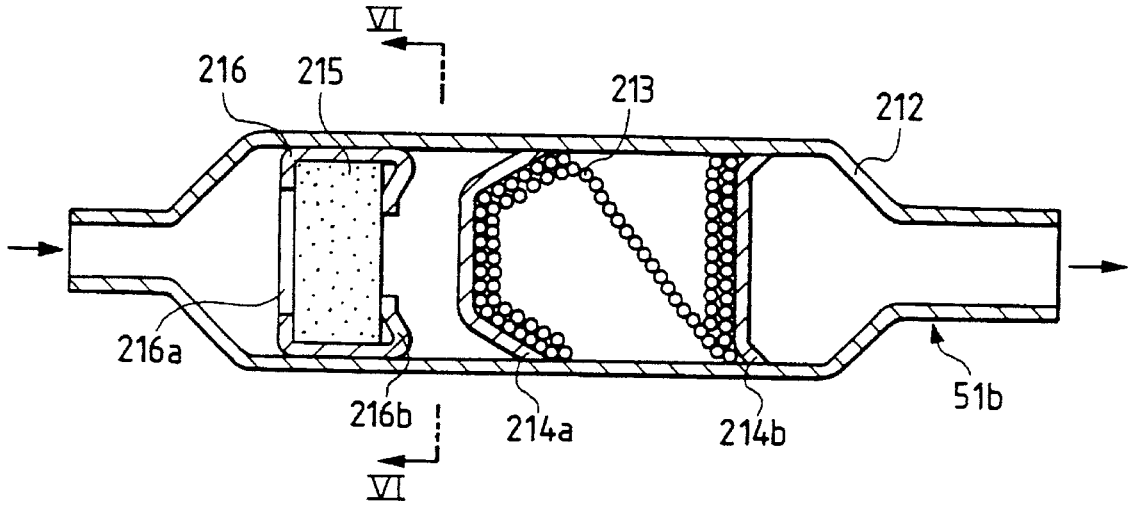
FIG. 5 is a sectional view showing a structure of a drier according to a third preferred embodiment of the present invention.

Now, a third preferred embodiment of the present invention will be described hereinbelow with reference to FIGS. 5 and 6. FIG. 5 is a sectional view showing a drier 51*b* according to the third preferred embodiment, and FIG. 6 is a sectional view taken along line VI—VI in FIG. 5.

The third preferred embodiment differs from the first preferred embodiment only in the structure of the drier 51*b*.

Figure 6:
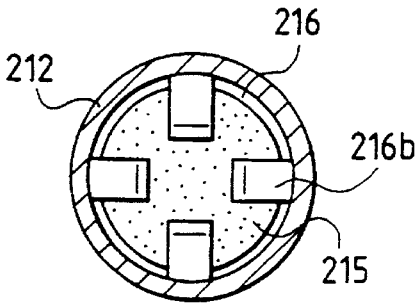
FIG. 6 is a sectional view taken along line VI—VI in FIG. 5.

In FIGS. 5 and 6, the drier 51*b* includes a copper case 212. The case 212 accommodates therein a molecular sieve 213 working as a water adsorber and first and second filters 214*a* and 214*b* each made of a metal screen of about a 150 mesh size and fixedly provided in the case 212 for fixedly supporting the molecular sieve 213.

The case 212 further includes therein a third filter 215 formed of a substantially disk or cylindrical shaped ceramic having a pore size of no more than 80 μm. The third filter 215 is firmly held by a cup-shaped holder 216 which is press-fitted in the case 212. The holder 216 is formed with an opening 216*a* at its upstream side for the refrigerant to pass therethrough and holding projections (four projections in this embodiment as shown in FIG. 6) 216*b* at its downstream side. The third filter 215 is firmly mounted in the holder 216 by bending the holding projections 216*b* inward, i.e. toward the third filter 215 after placing the third filter 215 in the holder 216. The holder 216 is fixedly arranged at a position spacing a given distance from the first filter 214*a* so as to prevent contact of the third filter 215 with the first filter 214*a*. Since the third filter 215 is securely held by the holder 216, generation of ceramic power from the third filter 215 due to, such as, vibration is effectively prevented so as to avoid harmful effects, such as, blocking of the expansion mechanism 4 and friction at the sliding parts of the compressor 1.

Figure 7:
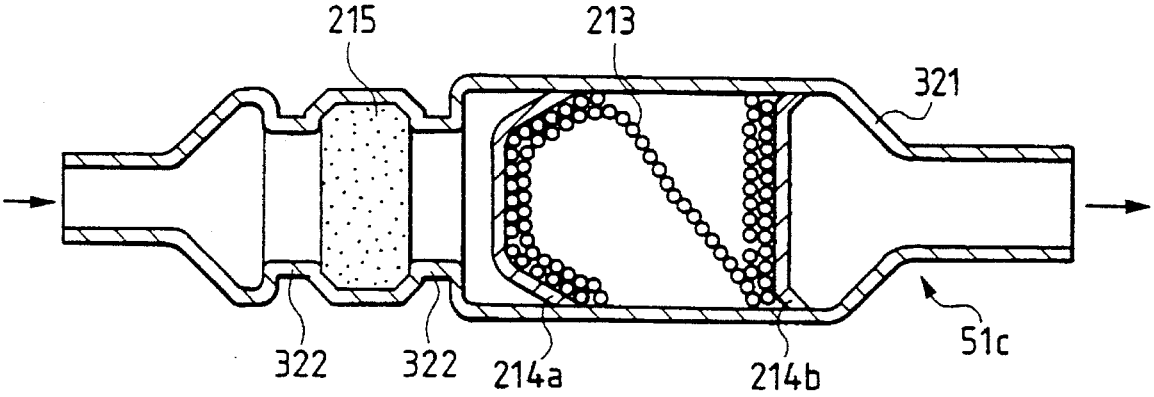
FIG. 7 is a sectional view showing a structure of a drier according to a fourth preferred embodiment of the present invention.

Now, a fourth preferred embodiment of the present invention will be described hereinbelow with reference to FIG. 7. FIG. 7 is a sectional view showing a drier 51*c* according to the fourth preferred embodiment.

The fourth preferred embodiment differs from the third preferred embodiment only in the structure of the drier 51*c*.

In FIG. 7, the drier 51*c* includes a copper case 321 which is formed with a pair of grooves 322, 322 on the circumference thereof. The third filter 215 is fixed between the grooves 322, 322 by using the drawing process. As in the third preferred embodiment, the third filter 215 is arranged at a position in the case 321 spacing a given distance from the first filter 214*a* so as to prevent contact of the third filter 215 with the first filter 214*a*. Since the third filter 215 is securely held between the grooves 322, 322, generation of ceramic power from the third filter 215 due to, such as, vibration is effectively prevented so as to avoid harmful effects, such as, blocking of the expansion mechanism 4 and friction at the sliding parts of the compressor 1.

As appreciated from the foregoing description, in the third and fourth preferred embodiments, the contaminants produced due to the dissolution of fats and oils and the like by the ester lubricating oil are effectively captured by the third filter as in the foregoing first and second preferred embodiment. Although the third filter is provided at the upstream side of the drier, the third filter may be provided at the downstream side of the drier or at both the upstream and downstream sides of the drier.

In the foregoing first to fourth preferred embodiments, since the drier 51 to 51*c* can be mounted in the piping of the refrigeration system 50 in the same manner as the conventional drier 3, the assembling efficiency is not deteriorated.

Figure 8:
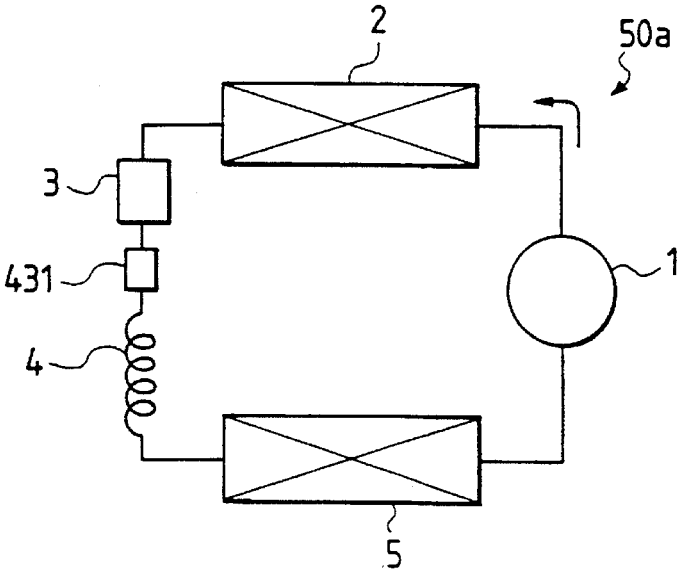
FIG. 8 is a systematic diagram showing a schematic structure of a refrigeration system according to a fifth preferred embodiment of the present invention.

Now, a fifth preferred embodiment of the present invention will be described hereinbelow with reference to FIGS. 8 and 9. FIG. 8 is a systematic diagram showing a schematic structure of the refrigeration system 50*a* according to the fifth preferred embodiment, wherein a filter casing 431 is added downstream of the conventional drier 3 which includes therein the molecular sieve supported between the metal screen filters of about a 150 mesh size, and FIG. 9 is a sectional view showing the filter casing 431.

The fifth preferred embodiment differs from the third preferred embodiment only in that the drier 51*b* is replaced by the conventional drier 3 and the filter casing 431 is provided in the refrigerant flow passage between the conventional drier 3 and the expansion mechanism 4.

Figure 9:
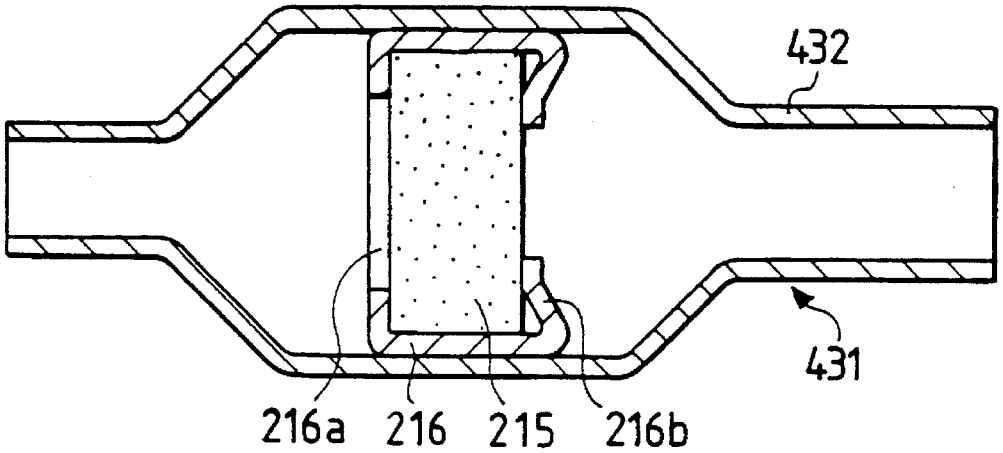
FIG. 9 is a sectional view showing a structure of a filter casing according to the fifth preferred embodiment.

In FIG. 9, the filter casing 431 includes a copper case 432 which accommodates therein the third filter 215 firmly held by the holder 216 which is press-fitted in the case 432. The mounting manners of the third filter 215 and the holder 216 are the same as those in the third preferred embodiment.

Figure 10:
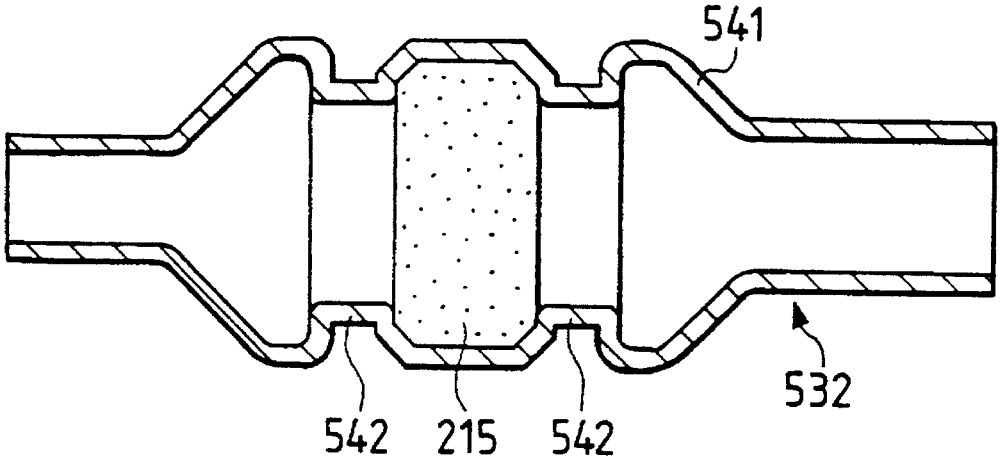
FIG. 10 is a sectional view showing a structure of a filter casing according to a sixth preferred embodiment of the present invention.

Now, a sixth preferred embodiment of the present invention will be described hereinbelow with reference to FIG. 10. FIG. 10 is a sectional view of a filter casing 532 provided in the refrigerant flow passage between the conventional drier 3 and the expansion mechanism 4.

The sixth preferred embodiment differs from the fifth preferred embodiment only in that the filter casing 431 is replaced by the filter casing 532.

In FIG. 10, the filter casing 532 includes a copper case 541 formed with a pair of grooves 542, 542 on the circumference thereof. The third filter 215 is firmly mounted in the case 541 between the grooves 542, 542 by using the drawing process as in the fourth preferred embodiment.

In the fifth and sixth preferred embodiments, the contaminants produced due to the dissolution of fats and oils and the like by the ester lubricating oil are effectively captured by the third filter in the filter casing, as in the first to fourth preferred embodiments.

In the fifth and sixth preferred embodiments, the ceramic filter is used, which, however, may be replaced by another filter having a pore size of no more than 80 μm. Similar effect may be attained to that of the ceramic filter. Further, in the fifth and sixth preferred embodiments, the filter casing 431, 532 is provided downstream of the drier 3, which, however, may be provided upstream of the drier 3 or both upstream and downstream of the drier 3.

Now, further preferred embodiments of the present invention will be described hereinbelow, wherein filters are incorporated inside hermetic refrigerant compressors, respectively, for capturing the contaminants produced due to the dissolution of fats and oils and the like by the ester lubricating oil.

Figure 11:
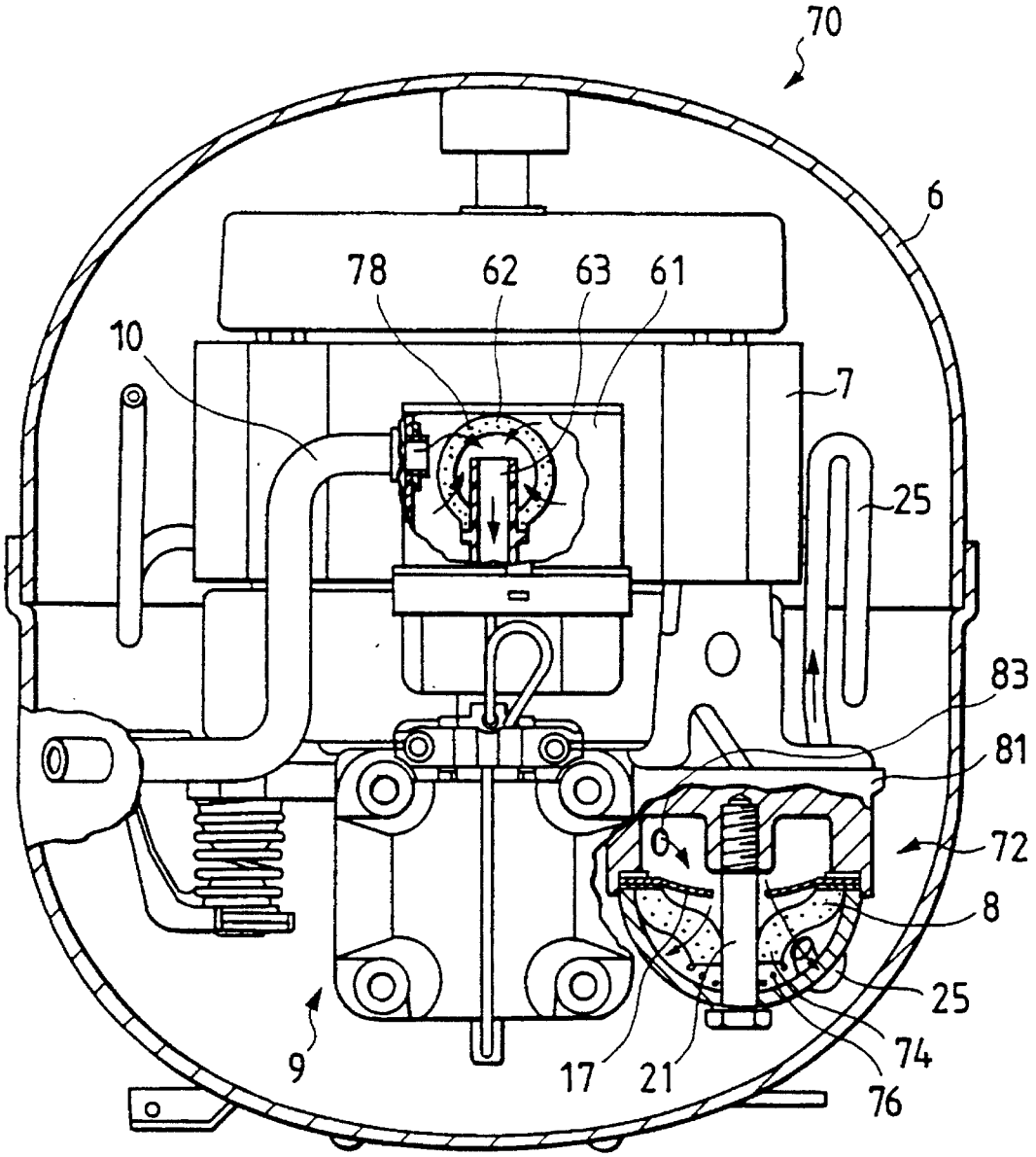
FIG. 11 is a sectional view showing a structure of a reciprocating refrigerant compressor according to a seventh preferred embodiment of the present invention.
Figure 12:
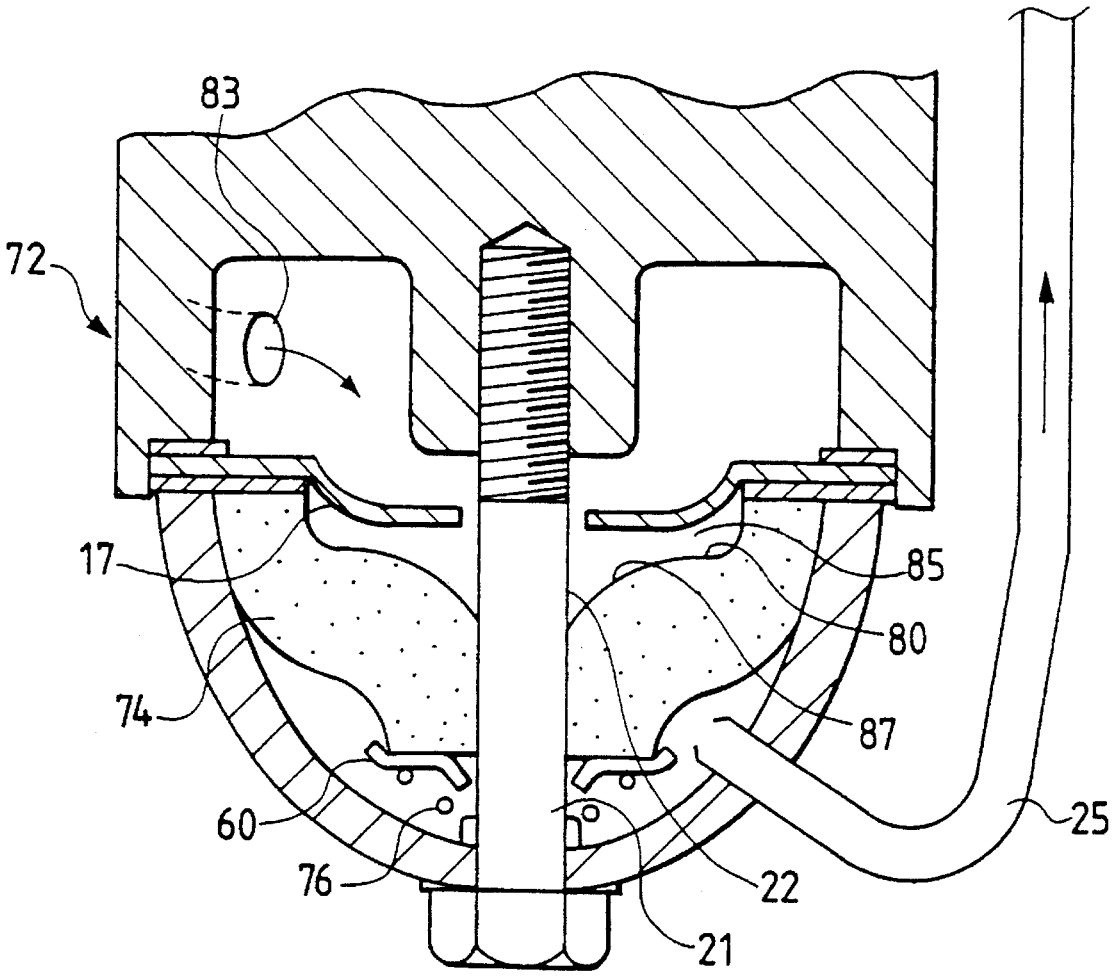
FIG. 12 is an enlarged sectional view showing a structure of a discharge part of the compressor of FIG. 11.

FIG. 11 is a sectional view showing a reciprocating refrigerant compressor according to a seventh preferred embodiment of the present invention, and FIG. 12 is an enlarged sectional view showing a discharge muffler section of the compressor in FIG. 11.

Figure 18:
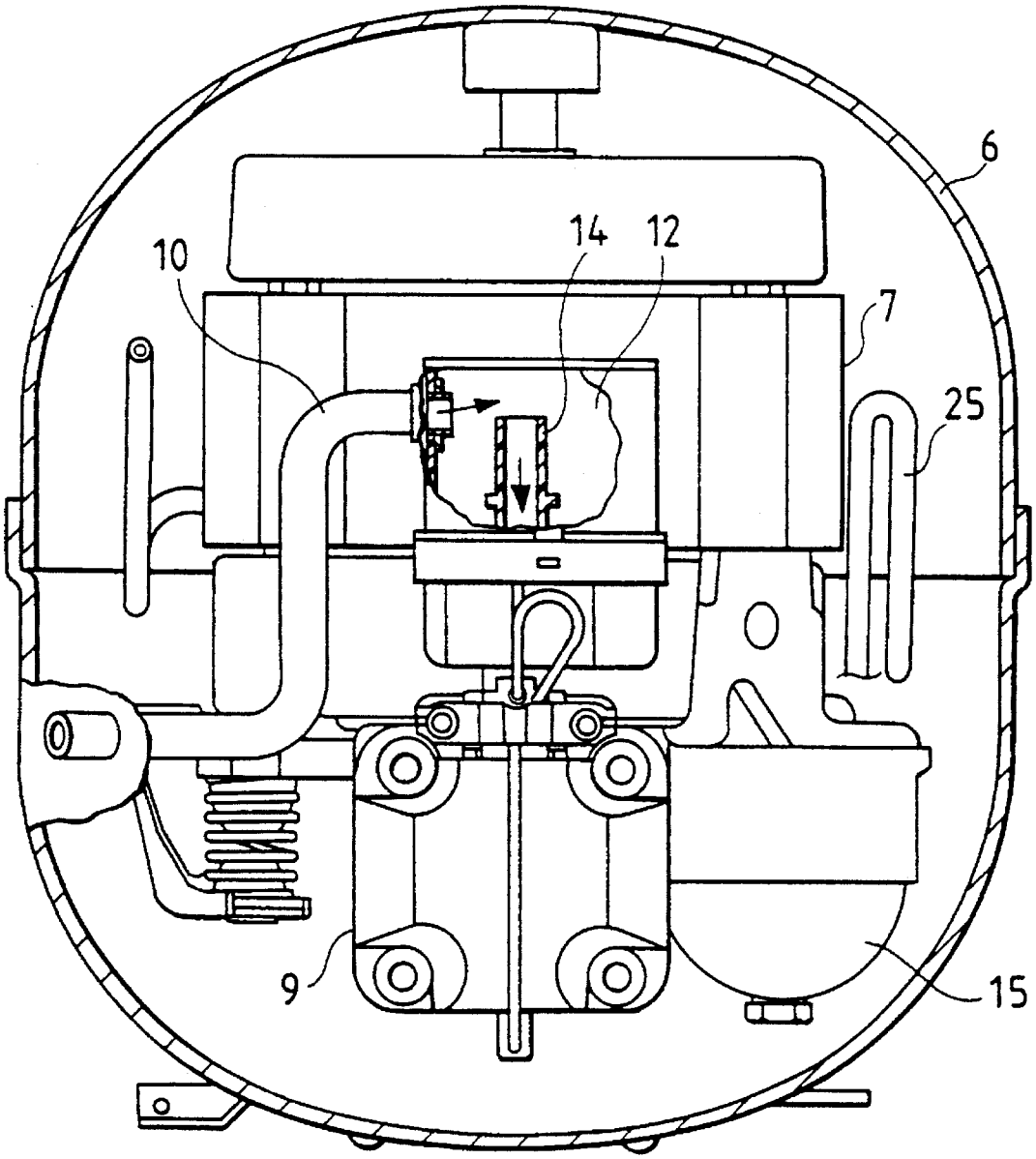
FIG. 18 PRIOR ART
FIG. 18 is a sectional view showing a structure of a conventional reciprocating refrigerant compressor.
Figure 19:
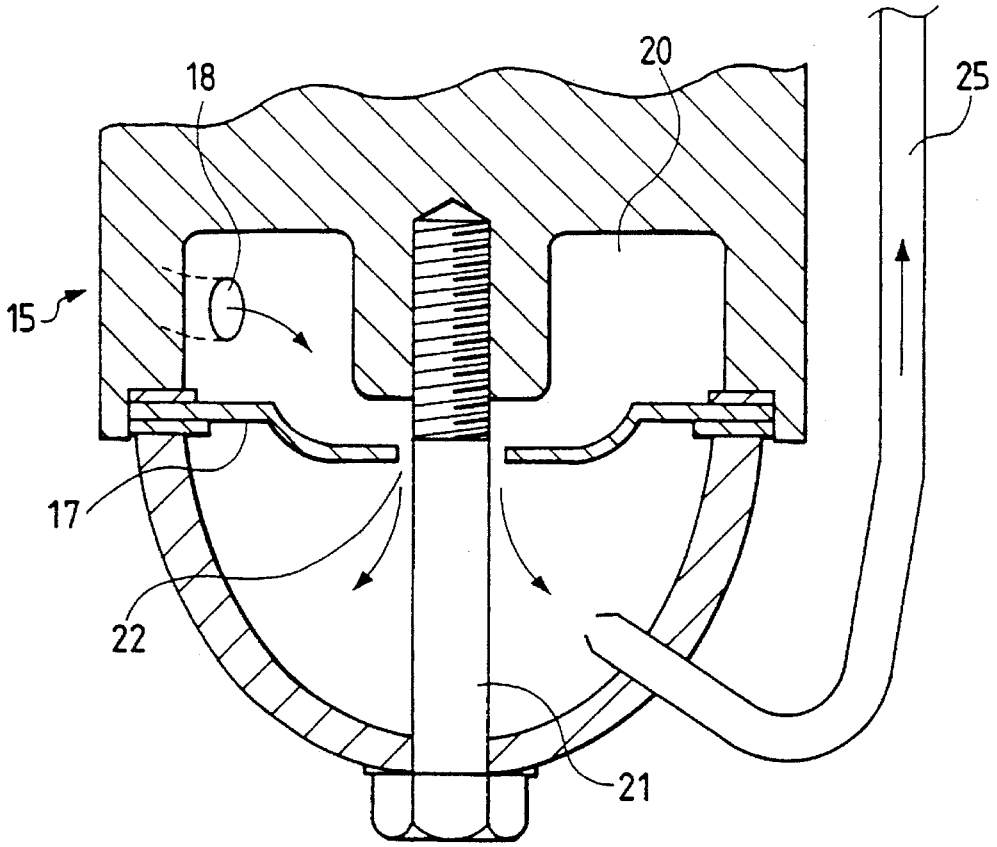
FIG. 19 PRIOR ART
FIG. 19 is an enlarged sectional view showing a structure of a discharge part of the compressor of FIG. 18.

In FIG. 11, numeral 70 represents the reciprocating refrigerant compressor according to the seventh preferred embodiment, which is an improvement of the conventional reciprocating refrigerant compressor shown in FIG. 18. Specifically, the compressor 70 includes filters in induction and discharge passages, respectively, of the compressing unit 9 incorporated in the sealed casing 6. In the induction passage of the compressing unit 9, a porous filter 62 of a spherical shape is mounted to an intake tube 63 as enclosing an upstream end of the intake tube 63 projected into an induction muffler 61. On the other hand, in the discharge passage of the compressing unit 9, a porous filter 74 of a bowl shape is mounted to a downstream side of the baffle 17 in a discharge muffler 72 as being pressed by a spring 76 via a sealing member 60 for preventing leakage of the refrigerant gas between the filter 74 and the downstream side of the baffle 17 and between the filter 74 and the bolt 21.

In the compressor 70 of this embodiment, the refrigerant gas is introduced into the sealed casing 6 via the induction pipe 10 and then passes through the filter 62 in the induction muffler 61 so as to be sucked into the cylinder via the intake tube 63. The contaminants generated in, such as, the evaporator 5 are captured as adhering to an outer side 78 of the filter 62.

On the other hand, the refrigerant gas pressurized by means of the cylinder and piston in the compressing unit 9 passes through the discharge muffler 72. Specifically, the compressed refrigerant gas is discharged via a discharge hole 83 formed in a block 81 of the compressing unit 9 into an upstream chamber of the discharge muffler 72 and then flows into a downstream chamber 85 of the discharge muffler 72 passing through the narrow annular gap 22 between the baffle 17 and the bolt 21. The refrigerant gas then passes through the filter 74. The contaminants generated in the sealed casing 6 and entering the refrigerant flow passage and the contaminants generated in the compressing unit 9 are captured as adhering to an inner side 87 of the filter 74. The refrigerant gas having passed through the filter 74, which is thus free of the contaminants, is discharged via the discharge pipe line 25 to the exterior of the sealed casing 6 for performing the given thermal work.

Each of the porous filters 62 and 74 employed in this embodiment is formed of the porous sintered metal having a pore size of no more than 75 μm. However, any of those filters as described in the foregoing first preferred embodiment and its modifications may be used as the filters 62 and 74.

When the porous burnt-hard desiccant is used as the filters 62 and 74, the desiccant, such as, the molecular sieve which has been used in the conventional drier is not necessary in the refrigeration system employing the compressor of this embodiment. The reason for this is that the manufacturing process of the refrigerant compressor of this type normally includes, after keeping the compressor at a temperature of 150° C. for about an hour, a drying process where the inside of the compressor is desiccated by evacuation. Accordingly, the burnt-hard desiccant filters are fully desiccated during this drying process so that the provision of another desiccant, i.e. the molecular sieve, becomes unnecessary.

Now, an eighth preferred embodiment will be described with reference to FIGS. 13 to 15.

Figure 13:
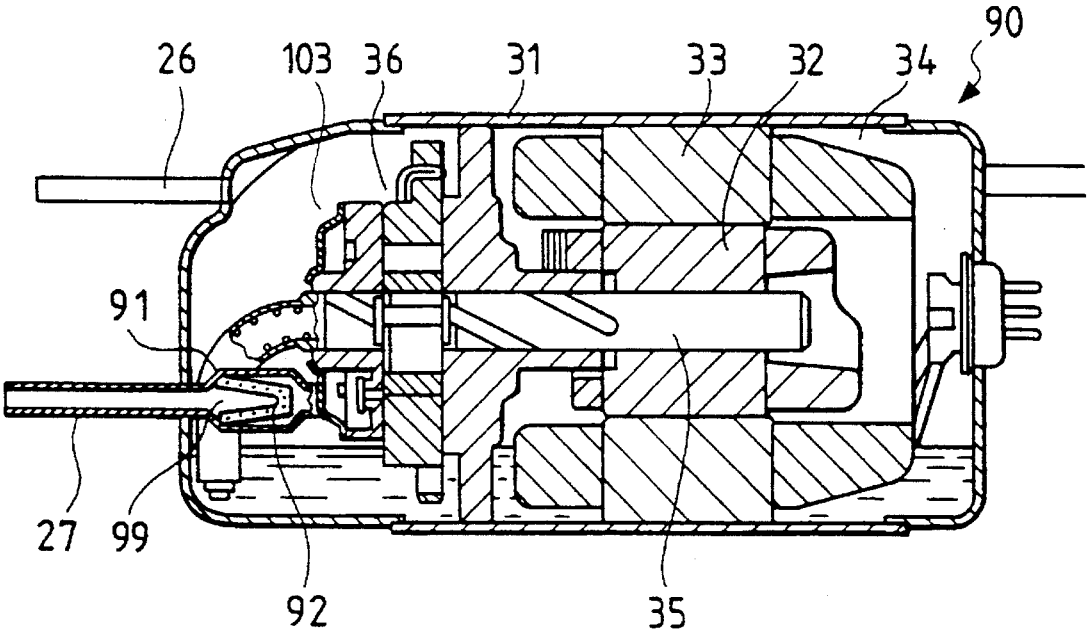
FIG. 13 is a sectional view showing a structure of a rotary refrigerant compressor according to an eighth preferred embodiment of the present invention.
Figure 14:
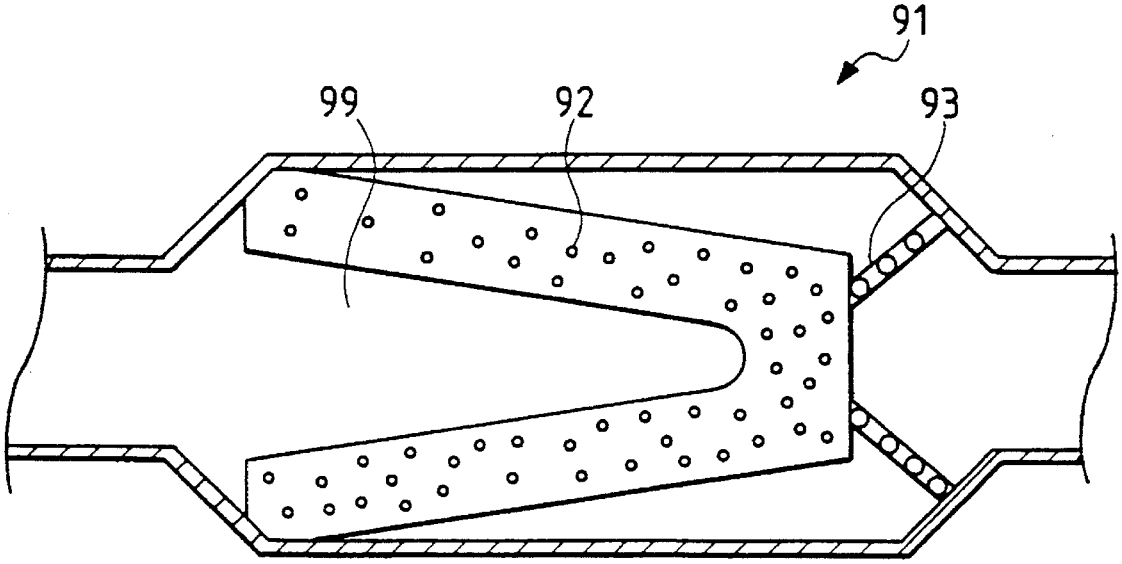
FIG. 14 is an enlarged sectional view showing an induction part of the compressor of FIG. 13.
Figure 15:
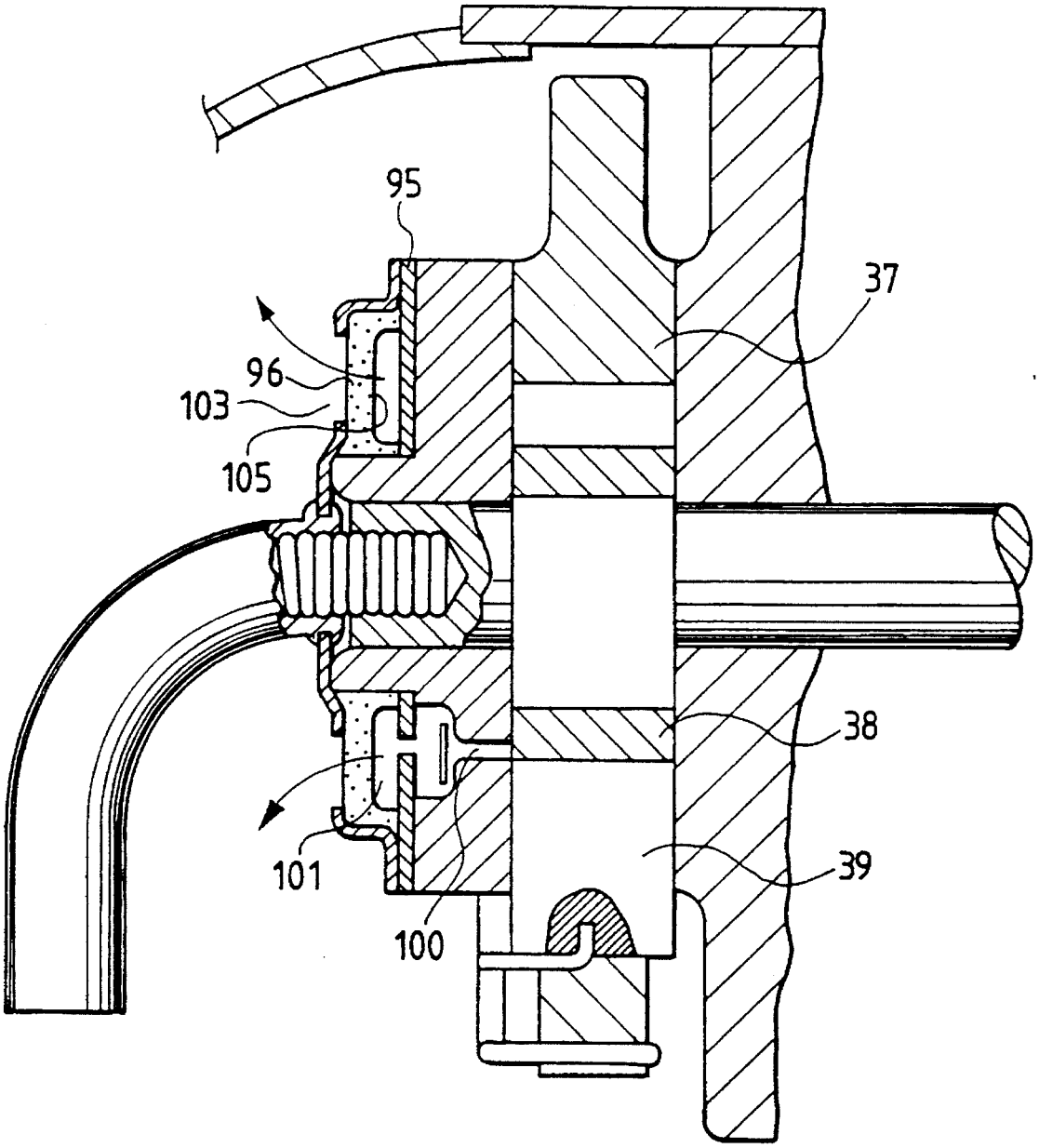
FIG. 15 is an enlarged sectional view showing a structure of a discharge part of the compressor of FIG. 13.

FIG. 13 is a sectional view showing a rotary refrigerant compressor according to the eighth preferred embodiment, FIG. 14 is an enlarged sectional view showing an induction part of the compressor in FIG. 13, and FIG. 15 is an enlarged sectional view showing a discharge part of the compressor in FIG. 13.

Figure 20:
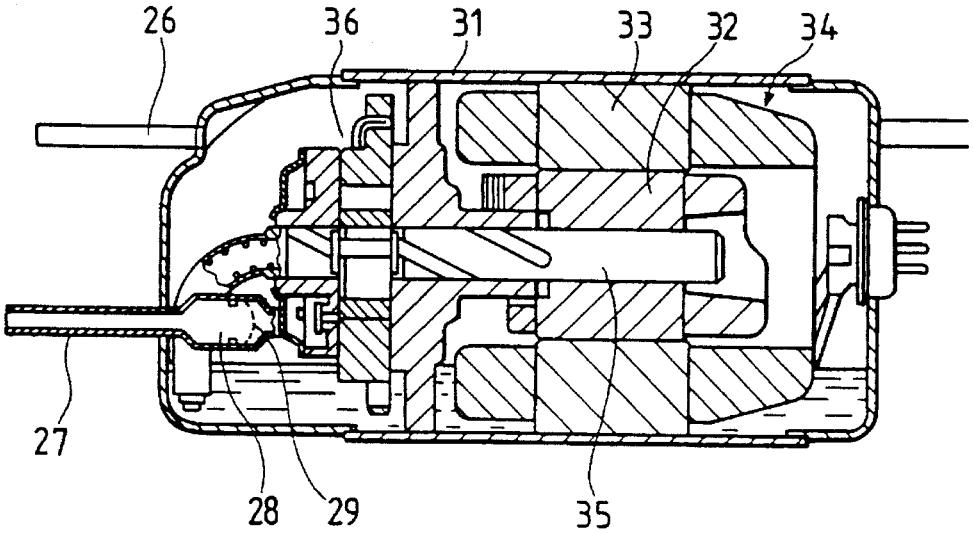
FIG. 20 PRIOR ART
FIG. 20 is a sectional view showing a structure of a conventional rotary refrigerant compressor.
Figure 21:
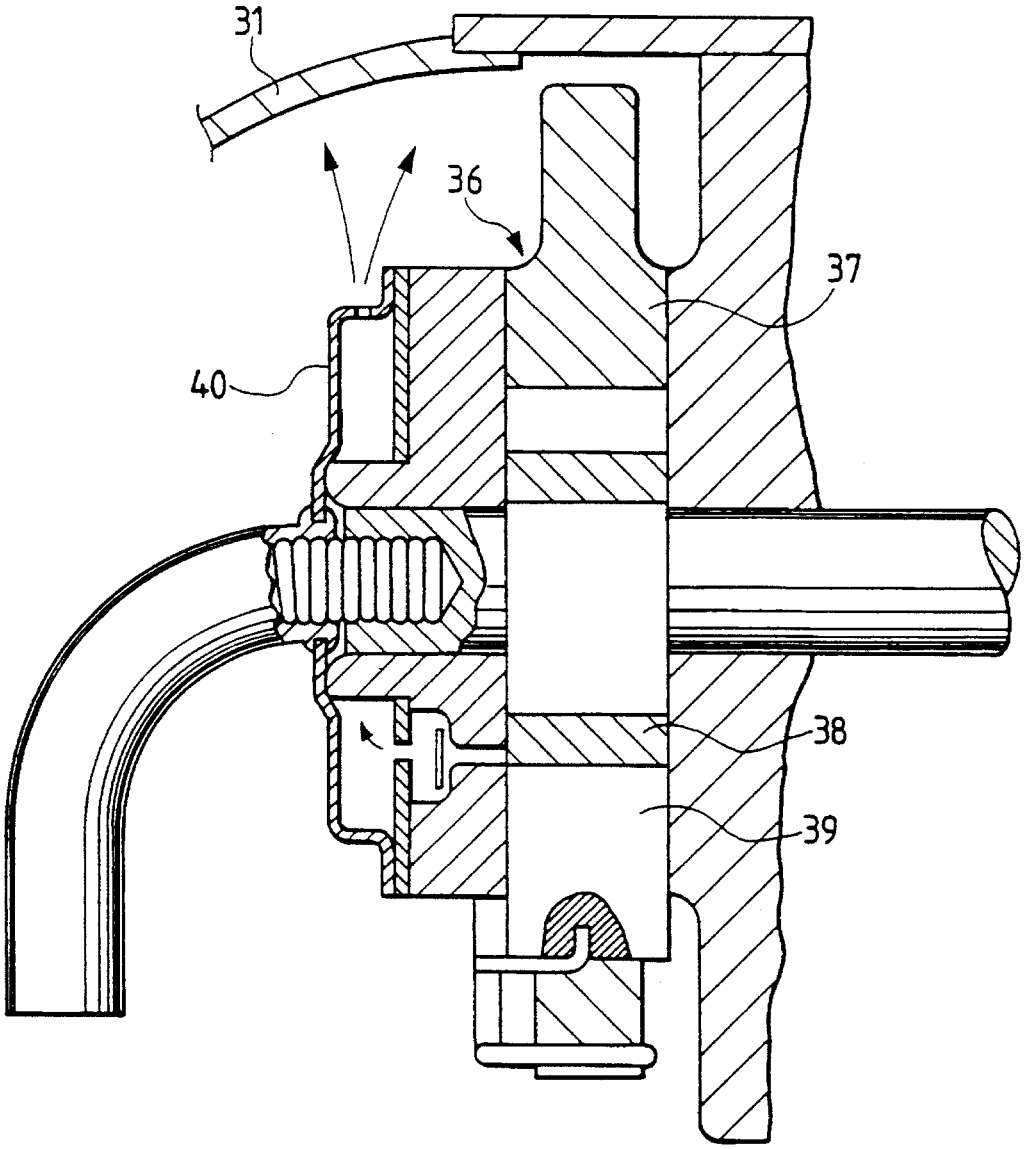
FIG. 21 PRIOR ART
FIG. 21 is an enlarged sectional view showing a structure of a discharge part of the compressor of FIG. 20.

In FIG. 13, numeral 90 represents the rotary refrigerant compressor according to the eighth preferred embodiment, which is an improvement of the conventional rotary refrigerant compressor shown in FIG. 20. Specifically, the rotary compressor 90 of this embodiment incorporates filters in induction passage and discharge passages, respectively, of the compressing unit 36. In the induction passage of the compressing unit 36, a porous filter 92 is firmly provided in an induction muffler 91 as being pressed by a spring 93. On the other hand, in the discharge passage of the compressing unit 36, a porous filter 96 of an annular plate shape is fixedly mounted in a discharge muffler 103 as entirely covering a baffle 95 with a given gap therebetween.

In the compressor 90 of this embodiment, the refrigerant gas is introduced into the induction muffler 91 via the induction pipe 27 and then passes through the filter 92 in the induction muffler 91 so as to be sucked into the cylinder 37. The contaminants generated in, such as, the evaporator 5 are captured as adhering to an upstream side 99 of the filter 92.

On the other hand, the refrigerant gas pressurized by the compressing unit 36 is discharged via a discharge hole 100 into the discharge muffler 103 and then passes through small openings 101 of the baffle 95 and further through the filter 96. The refrigerant gas is then discharged via the discharge pipe 26 after temporarily staying in the sealed casing 31. The contaminants generated, such as, in the compressing unit 36 and entering the refrigerant flow passage are captured as being adhering to an upstream side 105 of the filter 96.

As in the seventh preferred embodiment, any of those filters as described in the foregoing first preferred embodiment and its modifications may be used as the filters 92 and 96.

Now, a ninth preferred embodiment will be described with reference to FIG. 16.

Figure 16:
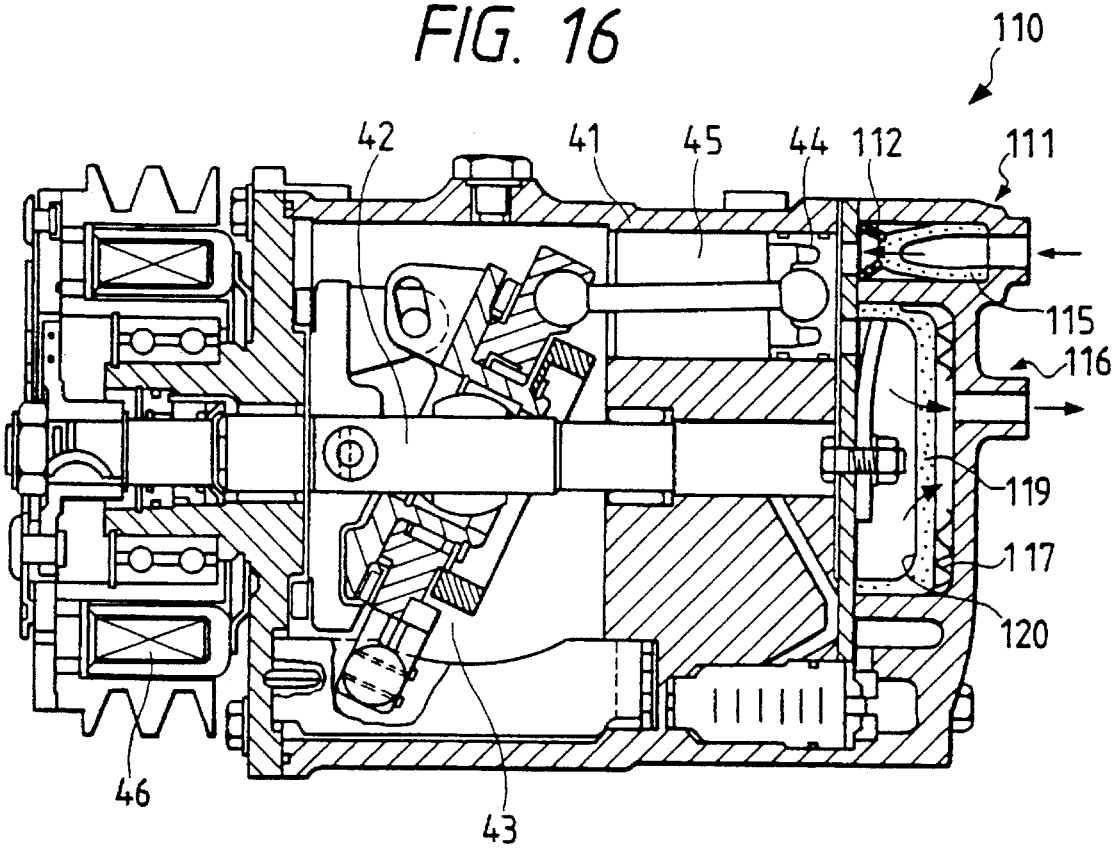
FIG. 16 is a sectional view showing a structure of a refrigerant compressor for a car air conditioner according to a ninth preferred embodiment of the present invention.
Figure 17:
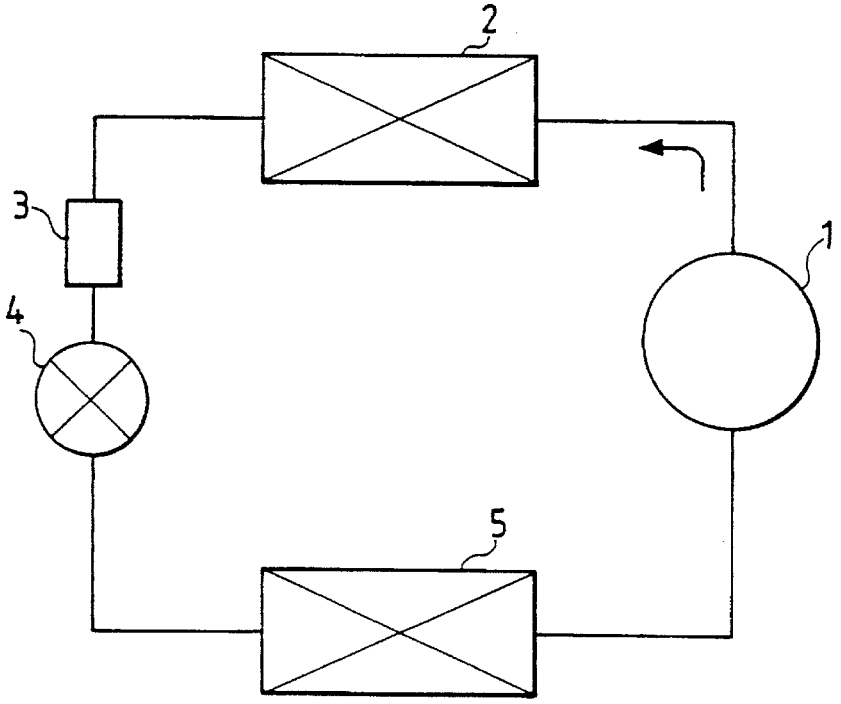
FIG. 17 PRIOR ART
FIG. 17 is a systematic diagram showing a schematic structure of a conventional refrigeration system.

FIG. 16 is a sectional view showing a refrigerant compressor of a car air conditioner according to the ninth preferred embodiment.

Figure 22:
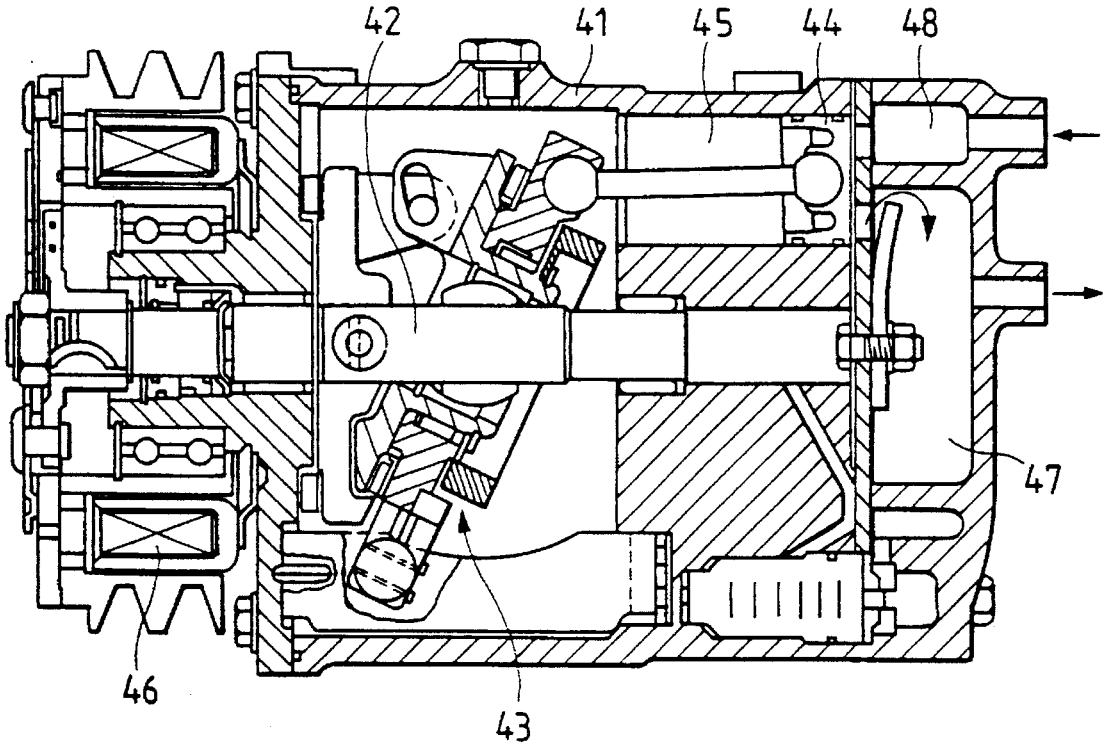
FIG. 22 PRIOR ART
FIG. 22 is a sectional view showing a structure of a conventional refrigerant compressor of a car air conditioner.

In FIG. 16, numeral 110 represents the refrigerant compressor of the car air conditioner according to the ninth preferred embodiment, which is an improvement of the conventional refrigerant compressor shown in FIG. 22. Specifically, the refrigerant compressor 110 of this embodiment incorporates filters in induction and discharge passages, respectively, of the compressing unit, as in the foregoing seventh and eighth preferred embodiments. In the induction passage of the compressing unit, a porous filter 115 formed of sintered metal having a pore size of 75 μm is firmly provided in an induction muffler 111 as being pressed by a spring 112. On the other hand, in the discharge passage of the compressing unit, a porous filter 119 formed of sintered metal having a pore size of 75 μm is firmly provided in a discharge muffler 116 as being pressed by a spring 117 so as to provide entire covering in the discharge muffler 116 as shown in FIG. 16.

In the compressor 110 of this embodiment, the contaminants generated in, such as, the evaporator 5 are captured as adhering to an upstream side of the filter 115. On the other hand, the contaminants generated, such as, in the sealed casing 41 and entering the refrigerant flow passage are captured as being adhering to an upstream side 120 of the filter 119.

As in the seventh and eighth preferred embodiments, any of those filters as described in the foregoing first preferred embodiment and its modifications may be used as the filters 115 and 119.

In the seventh to ninth preferred embodiments, the filters are provided both in the induction and discharge passages of the compressing unit. However, the filter may be arranged at least in one of the induction and discharge passages of the compressing unit.

When the filter is provided in the induction passage of the compressing unit, since the flow of the refrigerant gas is rectified when passing through the filter, an operation noise of the refrigerant compressor can be reduced. On the other hand, when the filter is provided in the discharge passage of the compressing unit, since a highest amount of the remaining fats and oils exists in the compressor due to its far more complicated structure than the other components in the refrigeration system, the filter in the discharge passage of the compressing unit immediately captures the contaminants generated in the refrigerant compressor.

Further, since the filter or filters are provided in the refrigerant compressor in the seventh to ninth preferred embodiments, no provision of another filter in the piping of the refrigeration system is necessary.

In the first to ninth preferred embodiments, the porous filter or filters are provided in the refrigerant flow passage of the refrigeration system. The contaminants are experientially of soft nature so as to be easily deformed. Accordingly, even if once captured by the conventional filter, the contaminants are easily deformed due to the flowing force of the refrigerant so as to be likely to separate from the filter to again flow in the refrigerant flow passage. Since the porous filter or filters are employed in the preferred embodiments of the present invention, the contaminants are captured in the fine pores of the filter so that the contaminants are not easily deformed. Accordingly, in the preferred embodiments of the present invention, the contaminants once captured do not escape from the filter.

Further, in the first to ninth preferred embodiments, the filter has a pore size of no more than 80 μm. Accordingly, the contaminants are almost completely captured by the filter. As described before, the contaminants are generated due to the dissolution of fats and oils and the like which are used during manufacturing of the refrigeration system and remain in the refrigeration system. Accordingly, once all the fats and oils and the like remaining are dissolved, no further contaminants are generated. As a result, although the filter has very fine pores, it is not likely that the filter pores are blocked with lapse of time.

As understood from the foregoing description, the refrigerant compressor and the refrigeration system according to the preferred embodiments of the present invention contribute toward practicability of the carbon hydride fluoride refrigerant as represented by the flon 134*a* so as to facilitate substitution of the flon 12, and thus contribute to the global environmental problem.

It is to be understood that this invention is not to be limited to the preferred embodiments and modifications described above, and that various changes and modifications may be made without departing from the spirit and scope of the invention as defined in the appended claims.

What is claimed is:

1. A refrigerant compressor comprising:

a sealed casing;

a motor provided in said sealed casing;

a compressing unit provided in said sealed casing to be driven by said motor; and a porous filter provided in at least one of a refrigerant induction passage and a refrigerant discharge passage of said compressing unit, wherein said porous filter is formed of a molded solid material constituted by alumina, silica gel, calcium sulfide and aluminosilicate.

2. A refrigerant compressor, comprising:

a sealed casing;

a motor provided in said sealed casing;

a compressing unit provided in said sealed casing to be driven by said motor; and a filter provided in at least one of a refrigerant induction passage and a refrigerant discharge passage of said compressing unit, said filter having a pore size of no more than 80 μm, wherein said filter is formed of a molded solid material constituted by alumina, silica gel, calcium sulfide and aluminosilicate.

* * * * *